US011441369B2

(12) United States Patent
Law et al.

(10) Patent No.: US 11,441,369 B2
(45) Date of Patent: Sep. 13, 2022

(54) FLUID COUPLING DRIVE SYSTEM FOR A DRILL RIG AIR COMPRESSOR

(71) Applicant: Harnischfeger Technologies, Inc., Wilmington, DE (US)

(72) Inventors: Arnold Law, Minneapolis, MN (US); Owen J. Warr, Muskego, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 813 days.

(21) Appl. No.: 14/820,594

(22) Filed: Aug. 7, 2015

(65) Prior Publication Data

US 2016/0040491 A1 Feb. 11, 2016

Related U.S. Application Data

(60) Provisional application No. 62/034,623, filed on Aug. 7, 2014.

(51) Int. Cl.

| | |
|---|---|
| ***E21B 21/16*** | (2006.01) |
| ***F04C 18/16*** | (2006.01) |
| ***E21B 7/02*** | (2006.01) |
| ***F04C 29/00*** | (2006.01) |

(52) U.S. Cl.

CPC ..... *E21B 21/16* (2013.01); *E21B 7/02* (2013.01); *E21B 7/022* (2013.01); *F04C 18/16* (2013.01); *F04C 29/005* (2013.01); *F04C 2210/1005* (2013.01); *F04C 2270/0525* (2013.01)

(58) Field of Classification Search

CPC . E21B 21/16; E21B 7/02; E21B 7/022; F04C 18/16; F04C 29/005; F04C 2210/1005; F04C 2270/0525; F16D 33/06; F16H 45/02

See application file for complete search history.

(56) References Cited

U.S. PATENT DOCUMENTS 2,109,297 A * 2/1938 McMurry ..... E21B 19/08 60/328
2,618,431 A * 11/1952 Walker ..... F04D 27/02 417/28
3,278,235 A * 10/1966 Bergstrom ..... E21B 7/02 299/37.2

(Continued)

FOREIGN PATENT DOCUMENTS

CN 201354836 Y 12/2009
CN 101688570 A 3/2010

(Continued)

OTHER PUBLICATIONS

Chilean Patent Office Action for Application No. 201502217 dated Jan. 23, 2018 (10 pages).

(Continued)

*Primary Examiner* — Robert E Fuller
(74) *Attorney, Agent, or Firm* — Michael Best & Friedrich LLP

(57) ABSTRACT

A drill rig includes a base, a drill tower coupled to and extending from the base, a drill pipe coupled to and supported by the drill tower, an air compressor coupled to the base, a prime mover coupled to the air compressor, and a fluid coupling disposed between and coupled to both the prime mover and the air compressor.

26 Claims, 3 Drawing Sheets

(56) References Cited

U.S. PATENT DOCUMENTS 3,607,779 A * 9/1971 King ..... A62C 3/0207 261/24
3,719,238 A * 3/1973 Campbell ..... E21B 19/084 173/147
3,792,836 A * 2/1974 Bender ..... E04H 12/34 254/361
3,986,564 A * 10/1976 Bender ..... E21B 3/02 173/4
4,055,315 A * 10/1977 Gvelesiani ..... B65G 51/04 406/185
4,062,187 A * 12/1977 Hilpert ..... B66D 1/24 60/326
4,133,177 A * 1/1979 Wilson ..... F16D 33/06 60/358
4,350,491 A 9/1982 Steuer
4,445,824 A * 5/1984 Bunn ..... F04B 49/24 417/440
4,549,856 A 10/1985 Cash et al.
4,585,080 A * 4/1986 Bender ..... E21B 7/024 173/29
5,222,418 A * 6/1993 Murota ..... F16H 57/0434 184/6.12
5,622,232 A 4/1997 Whisenhunt
5,728,021 A 3/1998 van Rooij et al.
5,813,227 A 9/1998 Dehrmann et al.
6,112,834 A 9/2000 Barrett
6,216,454 B1 4/2001 Tsuzuki
6,321,859 B1 11/2001 Boyd
6,321,891 B1 11/2001 Olsen et al.
6,446,738 B1 9/2002 Boyd
6,463,740 B1 * 10/2002 Schmidt ..... F25J 1/0294 60/772
7,350,352 B2 4/2008 Iwao et al.
7,785,229 B2 8/2010 Maddock
8,240,441 B2 8/2012 Heeke
8,282,522 B2 10/2012 Liu
8,527,169 B2 9/2013 Long et al.
8,646,549 B2 2/2014 Ledbetter et al.
2003/0230655 A1 * 12/2003 Giberson ..... B02C 25/00 241/101.2
2004/0007436 A1 * 1/2004 Wahl ..... F16H 45/02 192/30 R
2004/0208754 A1 * 10/2004 McFadden ..... F15B 11/17 417/286
2005/0099075 A1 * 5/2005 Roslund ..... F04C 23/02 310/85
2007/0246262 A1 * 10/2007 Brookover ..... E21B 44/00 175/27
2008/0245634 A1 * 10/2008 Basteck ..... F16D 33/06 192/3.3
2009/0071715 A1 * 3/2009 Sormunen ..... E21B 21/08 175/38
2010/0077743 A1 4/2010 Mori et al.
2011/0083903 A1 * 4/2011 Ledbetter ..... E21B 7/022 175/107
2001/2152678 6/2012 Samie et al.
2012/0152678 A1 * 6/2012 Samie ..... F16H 45/02 192/3.3
2012/0180482 A1 7/2012 Kapich
2012/0255825 A1 * 10/2012 Ochi ..... F16H 45/02 192/3.29
2012/0285896 A1 * 11/2012 Black ..... B01D 17/047 210/741
2013/0004337 A1 * 1/2013 Anderson ..... F04B 49/065 417/53
2013/0086896 A1 4/2013 Scherrle et al.
2013/0174538 A1 7/2013 Takashima et al.
2013/0319765 A1 * 12/2013 Piipponen ..... E21B 7/025 175/24
2014/0017091 A1 1/2014 Tobergte et al.

FOREIGN PATENT DOCUMENTS

CN 205063816 U 3/2016
GB 992141 A * 5/1965 ..... F04C 18/16
KR 20050069750 A 7/2005
WO 03093699 A1 11/2003
WO 2009077656 A1 6/2009
WO 2014044476 A2 3/2014

OTHER PUBLICATIONS

Office Action from the Chinese patent Office for related Application No. 201510482549.3 dated Jul. 2, 2018 (9 pages).
Substantive Report from the Chilean Patent Office for related Application No. 201502217 dated Oct. 25, 2018 (10 Pages).
Australian Patent Office Action for Application No. 2015210448 dated Aug. 19, 2019 (3 pages).
Lin et al., "Fluid Machinery" China University of Mining Textbooks, published Jul. 2014.
Lin et al., "Fluid Machinery" China University of Mining Textbooks, published Jul. 2014, English language translation included (14 pages).
Chinese Patent Office Action for Application No. 201510482549.3 dated Jul. 3, 2019 (6 pages).
Chinese Patent Office Notice of Reexamination for Application No. 201510482549.3 dated Mar. 24, 2021 (16 pages including English translation ).

* cited by examiner

FLUID COUPLING DRIVE SYSTEM FOR A DRILL RIG AIR COMPRESSOR

CROSS-REFERENCE TO RELATED APPLICATIONS

This application claims priority to U.S. Provisional Application No. 62/034,623, filed Aug. 7, 2014, the entire contents of which are incorporated herein by reference.

FIELD OF THE INVENTION

The present invention relates to drill rigs, and more specifically to an air compressor for a blasthole drill rig.

BACKGROUND

Blasthole drill rigs are commonly used in the mining industry to drill through hard rock. Blasthole drill rigs can be found, for example, in coal, copper, and diamond mines throughout the world. A blasthole drill rig typically includes a base, a drill tower extending vertically from the base, and a drill pipe or pipes that are coupled to and supported by the drill tower, and extend into a borehole. The blasthole drill rig also includes an air compressor, driven by a prime mover, that directs compressed air (e.g., at 100 psi) into the borehole to flush bit cuttings from the bottom of the borehole to the surface.

Oil flooded rotary screw air compressors have typically been the preferred type of air compressor in blasthole drill rigs due to their compact size and long operating life. This is despite the fact that these types of air compressors waste energy and fuel during standby operations (i.e., when no drilling is occurring). For example, some oil flooded rotary screw air compressors consume approximately 60% or more of a drill rig's operating power during drilling operations, but consume approximately 95% during the standby operations.

Recently, however, the size of oil flooded rotary screw air compressors has increased in order to meet demands for increased rates of penetration (i.e., the speeds at which the drill bit breaks the rock). Because of the increase in size of the oil flooded rotary screw air compressors, as well as recent increases in the cost of fuel, there has grown a need for a more energy-efficient manner to produce compressed air on a blasthole drilling rig.

One attempt at solving this problem has been to use a mechanical wet clutch system that disconnects the oil flooded rotary screw air compressor from the diesel engine during the standby operations. However, the wet clutch system requires a separate friction clutch that wears significantly over time. Additionally, the disconnection created by the wet clutch causes a total stoppage of the oil flooded rotary screw air compressor, which results in increased, non-productive operator time to refill an air storage/separator tank.

Another attempt at solving the problem has been to use a modified air control system, where the oil flooded rotary screw air compressor continues to be run at full speed (i.e., full engine rpm) at all times, but where air is vacuumed from a discharge port of the oil flooded rotary screw air compressor, and at the same time air is restricted from entering the oil flooded rotary screw air compressor, thereby reducing the compression ratio and mass of air being compressed while still operating the oil flooded rotary screw air compressor at full speed. However, this air control system requires additional compressor air and oil valves, a hydraulic powered vacuum pump, and sensors. Additionally, because the oil flooded rotary screw air compressor continues to operate at full speed at all times, the air control system suffers from significant rotational wear in a short amount of time.

SUMMARY

In accordance with one construction, a drill rig includes a base, a drill tower coupled to and extending from the base, a drill pipe coupled to and supported by the drill tower, an air compressor coupled to the base, a prime mover coupled to the air compressor, and a fluid coupling disposed between and coupled to both the prime mover and the air compressor.

In accordance with another construction, a method of operating an air compressor on a drill rig includes varying an amount of oil within a fluid coupling that is coupled to both the air compressor and to a prime mover, and while varying the amount of oil, maintaining a constant speed of the prime mover to generate slippage between an input pump in the fluid coupling and an output turbine in the fluid coupling.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
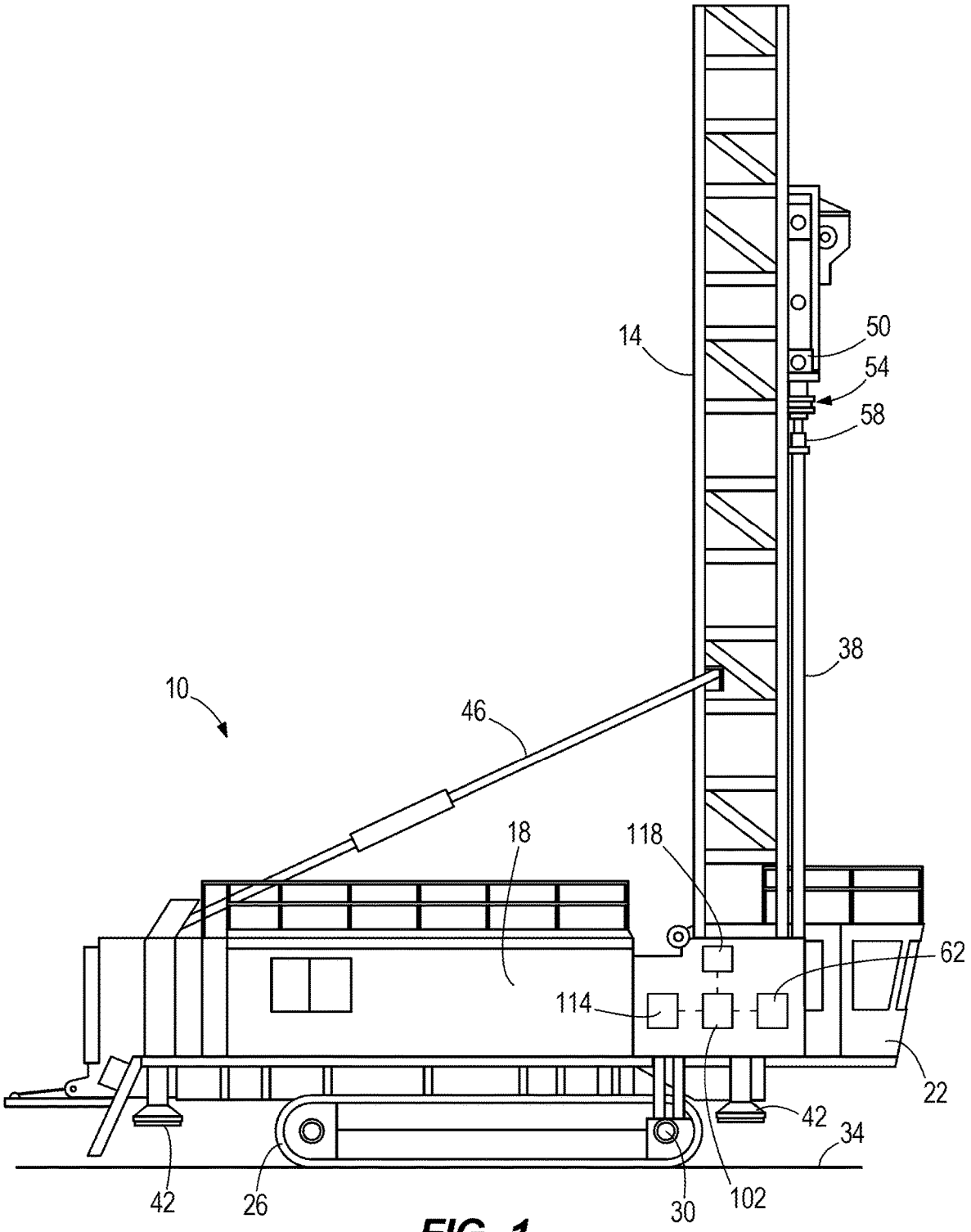
FIG. 1 is a side view of a drill rig according to one construction.

With reference to FIG. 1, a blasthole drill 10 includes a drill tower 14, a base 18 (e.g., a machinery house) beneath the drill tower 14 that supports the drill tower 14, an operator's cab 22 coupled to the base 18, and crawlers 26 driven by a crawler drive 30 that drive the drill 10 along a ground surface 34. The drill tower 14 is coupled to and supports a drill pipe 38 (e.g., with a drill bit, not shown), which is configured to extend vertically downward through the ground 34 and into a borehole. In some constructions, multiple drill pipes 34 are connected together to form an elongated drill string that extends into the borehole.

The drill 10 also includes leveling jacks 42 coupled to the base 18 that support the drill 10 on the surface 34, and a brace 46 coupled to both the base 18 and the drill tower 14 that supports the drill tower 14 on the machinery house 18. The drill tower 14 includes a drill head motor 50 that drives a drill head 54, and a coupling 58 that couples together the drill head 54 with an upper end of the pipe 38.

Figure 2:
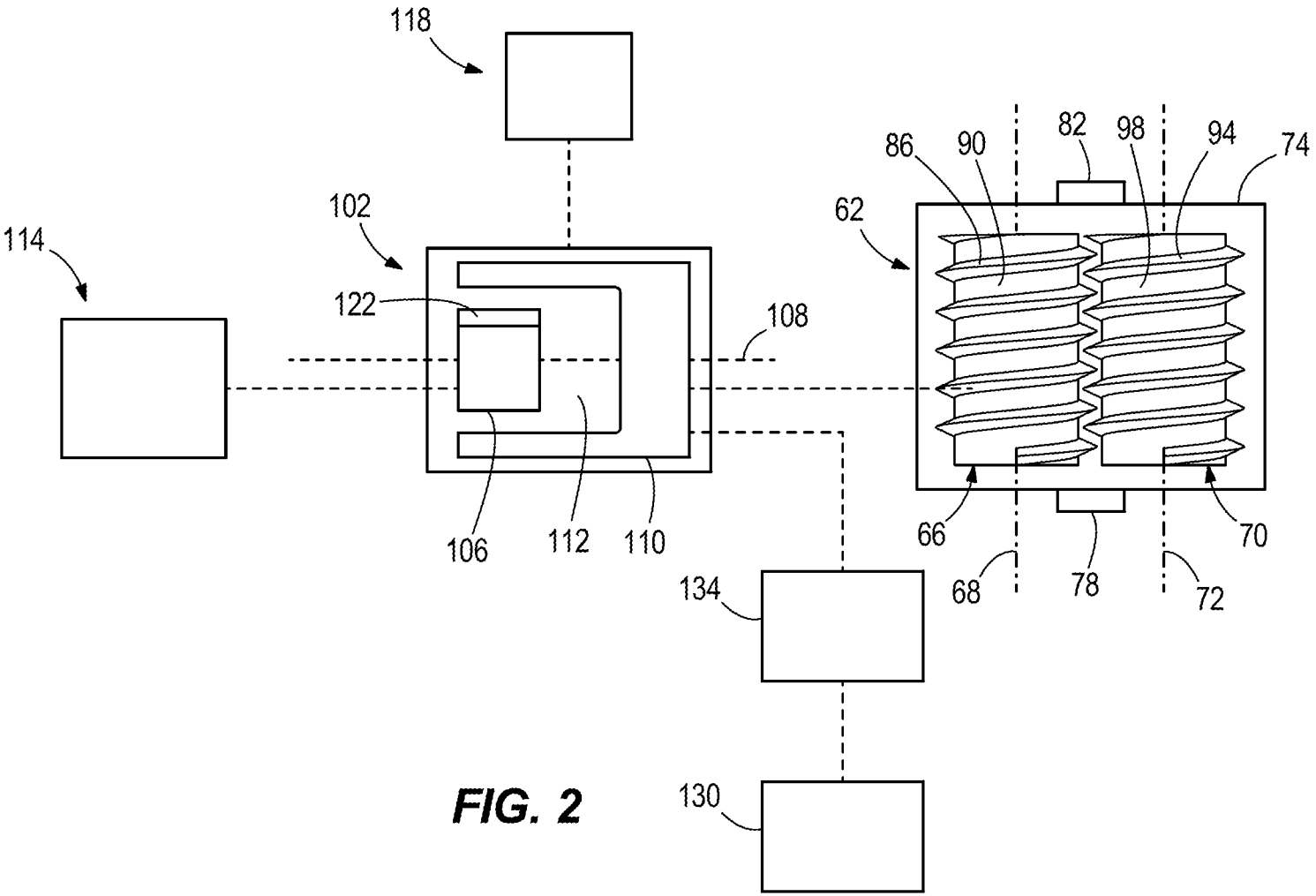
FIG. 2 is a schematic view of an air compressor, prime mover, and fluid coupling of the drill rig of FIG. 1.

With reference to FIGS. 1 and 2, the drill 10 further includes an air compressor 62 coupled to and disposed within the base 18 for flushing bit cuttings from the bottom of the borehole to the surface. In the illustrated construction, the air compressor 62 is an oil flooded rotary screw air compressor, although other constructions include different types of air compressors.

As illustrated in FIG. 2, the air compressor 62 is a lubricant-injected, rotary screw compressor that includes a main rotor 66 that rotates about an axis 68 and a secondary rotor 70 that rotates about an axis 72, both the main rotor 66 and the secondary rotor 70 being disposed in a stator housing 74. The stator housing 74 includes an air inlet port 78 and an air outlet port 82. The main rotor 66 has helical lobes 86 and grooves 90 along a length of the main rotor 66, while the secondary rotor 70 has corresponding helical lobes 94 and grooves 98 along a length of the secondary rotor 70. Air flowing in through the inlet port 78 fills spaces between the helical lobes 86, 94 on each rotor 66, 70. Rotation of the rotors 66, 70 causes the air to be trapped between the lobes 86, 92 and the stator housing 74. As rotation continues, the lobes 86 on the main rotor 66 roll into the grooves 98 on the secondary rotor 70 and the lobes 94 on the secondary rotor 70 roll into the grooves 90 on the main rotor 66, thereby reducing the space occupied by the air and resulting in increased pressure. Compression continues until the inter-lobe spaces are exposed to the air outlet port 82 where the compressed air is discharged. Lubricant is injected into the stator housing 74 during the compression of the air. The lubricant lubricates the intermeshing rotors 66, 70 and associated bearings (not shown).

With continued reference to FIGS. 1 and 2, the air compressor 62 is driven by a fluid coupling 102. The fluid coupling 102 includes an input pump 106 and a separately spaced output turbine 110 that both rotate about an axis 108, and are separated by a gap 112 inside the fluid coupling 102. As illustrated in FIG. 2, the output turbine 110 is coupled to the main rotor 66 of the air compressor 62, and the input pump 106 is coupled to a prime mover 114 (e.g., the flywheel of a diesel engine in the drill 10). In the illustrated construction, the fluid coupling 102 is a hydrodynamic device that uses oil within the gap 112 to transfer momentum from the input pump 106 to the output turbine 110. For example, when the prime mover 114 is activated, the prime mover 114 causes the input pump 106 to rotate, which causes oil adjacent the input pump 106 in the gap 112 to rotate and to be pumped toward the output turbine 110, thereby causing the output turbine 110 to also rotate. Rotation of the output turbine 110 causes rotation of the main rotor 66 in the air compressor 62.

With continued reference to FIGS. 1 and 2, the fluid coupling 102 is optimally controlled with a control system 118. The control system 118 varies the amount of oil in the fluid coupling 102, while keeping the prime mover 114 operating at constant speed. Controlling the amount of oil in the fluid coupling 102 generates varying slippage between the input pump 106 and the output turbine 110, thereby creating variable speed control in the air compressor 62.

The variable speed control of the fluid coupling 102 provides fuel and energy savings for the prime mover 114. For example, when a standby period occurs (i.e., when there is no drilling), the control system 118 removes some of the oil from within the fluid coupling 102, which generates greater slippage between the input pump 106 and the output turbine 110, and causes the output turbine 110 (and the main rotors 66, 70 coupled thereto) to slow down. When the standby period is over (i.e., when drilling resumes), the control system 118 adds oil back in to the fluid coupling 102, and the rotors 66, 70 are quickly brought back up to speed to resume compressing air at full speed. This ability to quickly bring the rotors 66, 70 back up to full speed reduces the amount of fuel and energy typically required to fully re-start the air compressor 62 every time a drilling operation occurs.

In some constructions, the drill 10 experiences extended periods of standby during operation (e.g., when tramming the drill 10 long distance, during operator crew change, or in an arctic environment where the prime mover 114 is not shut down due to likely difficulty of restarting). In this situation the control system 118 removes all or substantially all of the oil from the fluid coupling 102, creating a disconnect between the input pump 106 and the output turbine 110. Once the oil is drained the output turbine 110 and the rotors 66, 70 remain stationary, but the input pump 106 continues to rotate (e.g., freewheels) due to its continued connection with the prime mover 114. Thus, the prime mover 114 simply continues to run at the same speed, without having to expend extra fuel to slow down or re-start itself.

The variable speed control of the fluid coupling 102 also advantageously provides a soft-start option that allows the prime mover 114 to operate at a higher fuel efficiency when re-starting the air compressor 62. For example, when the output turbine 110 and the rotors 66, 70 of the air compressor 62 are still stationary, oil is slowly added to the fluid coupling 102, and the speed of the output turbine 110 and the rotors 66, 70 are gradually increased in a correspondingly slow, or soft, manner. This reduces the amount of fuel and energy typically required to start an oil flooded rotary screw compressor from standstill.

In some constructions, the fluid coupling 102 also has the added feature of a lock-up structure or structures 122 that physically link and connect the input pump 106 to the output turbine 110 when the fluid coupling 102 is operating at full or near full operating speed (e.g., when the input pump is operating at 70% or more of a maximum operating speed). In some constructions, the lock-up structure is a collection of pads or other structures on the input pump 106 and/or output turbine 110 that expand radially due to centrifugal force to engage the other of the input pump 106 or output turbine 110 at high speeds and to lock in rotation of the input pump 106 with the rotation of the output turbine 110. Other constructions include different lock-up structures. The rotational locking of the input pump 106 to the output turbine 110 eliminates slippage between the input pump 106 and the output turbine 110 at full operating speeds, thereby optimally improving mechanical efficiency of the fluid coupling 102 and the air compressor 62 at these speeds.

In some constructions, the fluid coupling 102 also reduces the need for venting of excess air in the air compressor 62 to the atmosphere (i.e., commonly referred to as blow-down). For example, it is common to vent excess air to the environment if an oil flooded rotary screw air compressor is too large for a given borehole, and there is too much air being generated by the oil flooded rotary screw air compressor for the given borehole. Such venting is often noisy and disruptive. By using a variable speed fluid coupling 102, the need to vent is reduced because the control system 118 can be used to slow down or speed up the output of the air compressor 62 as desired to more appropriately match the amount of air needed for a given borehole.

The fluid coupling 102 additionally allows for continuous, smooth, and varying changes in the speed of the air compressor 62, without the use of additional wear parts (e.g., clutches like in the wet clutch system described above). This lack of additional wear parts provides for extended life of the fluid coupling 102 and the air compressor 62.

The fluid coupling 102 also does not require additional pneumatic valves or a vacuum pump to be continuously powered to suck the air out of an outlet of the air compressor 62, as with the air control system described above.

The control system 118 also has a much simpler control when controlling between high speed lock up operation and low speed start up and freewheeling disconnected operation, as compared with the control system for a wet clutch system or air control system.

In some constructions, use of the fluid coupling 102 reduces fuel and energy consumption on a drill rig by as much as 50% as compared with a system that directly couples the prime mover 114 to the air compressor 62. This can result in hundreds of thousands of dollars of savings over the course of a year (e.g., 6000 operating hours) for a prime mover like prime mover (114).

With continued reference to FIG. 2, in some constructions, the fluid coupling 102 is also, or alternatively, coupled to a hydraulic pump 130 (or other pump or device that may be driven by a prime mover and/or fluid coupling). In the illustrated construction, for example, the output turbine 110 is coupled to a power transfer transmission 134, which is coupled to the hydraulic pump 130, such that rotation of the power output turbine 110 powers the hydraulic pump 130. In some constructions the hydraulic pump 130 (or both the hydraulic pump 130 and the power transfer transmission 134) are coupled instead to the input pump 106 of the fluid coupling 102, such that rotation of the input pump 106 powers the hydraulic pump 130.

Figure 3:
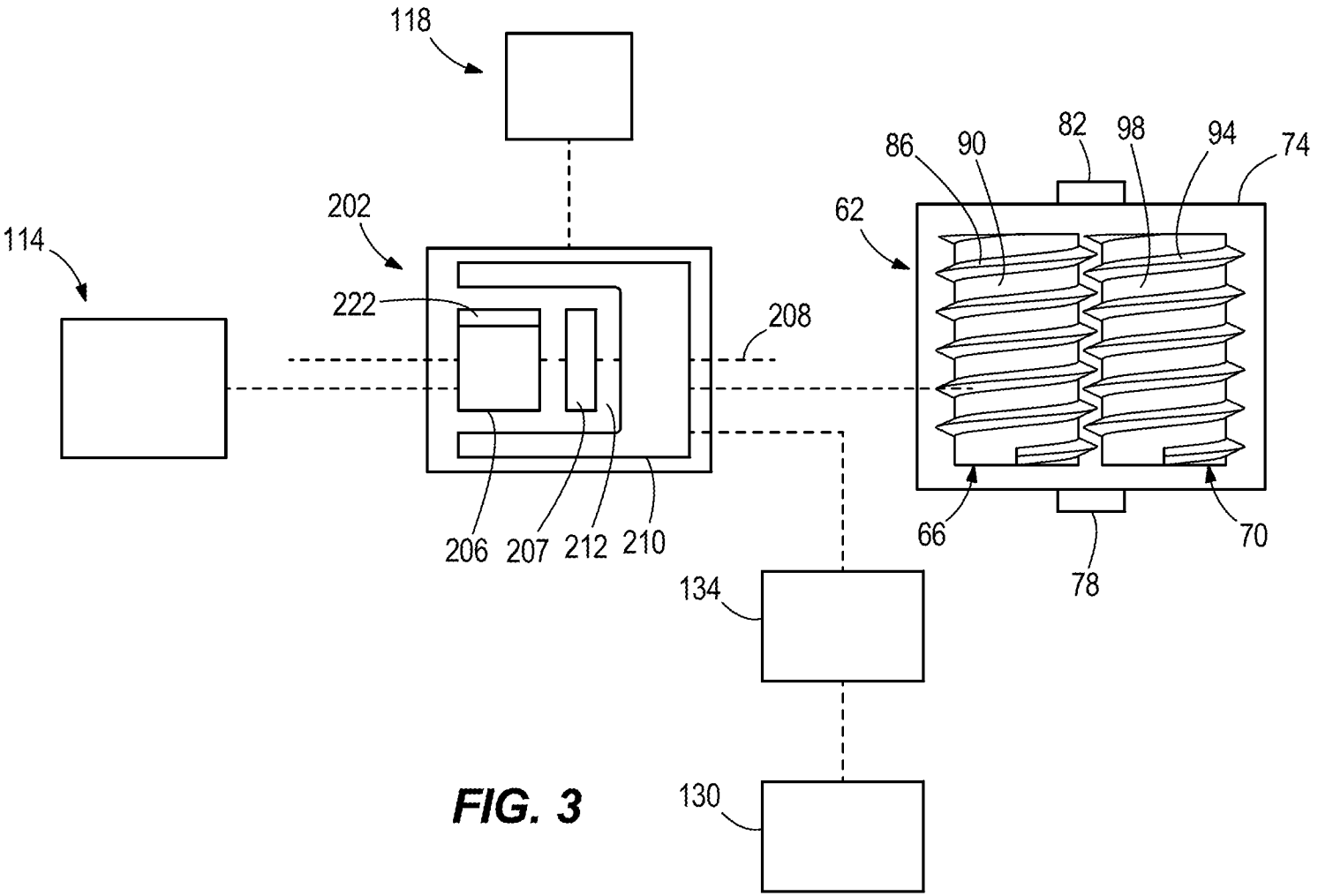
FIG. 3 is a schematic view of the air compressor and the prime mover of FIG. 2, and a fluid coupling according to another construction.

With reference to FIG. 3, in some constructions, a torque converter fluid coupling 202 is used instead of the fluid coupling 102. The torque converter fluid coupling 202 is identical to the fluid coupling 102, except that an additional turbine 207 is provided between the input pump 206 and the output turbine 210. The additional turbine 207 redirects at least a portion of the flow of oil back to the input pump 206 for increased efficiency and torque amplification at high slip speeds. The torque converter fluid coupling 202 generates increased torque during start-up so that the prime mover 114 does not have to work as hard during start-up of the torque converter fluid coupling 202, thus providing even further fuel savings for the prime mover 114.

Although the invention has been described in detail with reference to certain preferred embodiments, variations and modifications exist within the scope and spirit of one or more independent aspects of the invention as described.

What is claimed is:

1. A drill rig comprising:

a base;

a drill tower coupled to and extending from the base;

a drill pipe coupled to and supported by the drill tower;

an air compressor coupled to the base;

a prime mover coupled to the air compressor;

a control system; and a fluid coupling coupled to and operated by the control system, wherein the air compressor is configured to be driven by the fluid coupling, wherein the fluid coupling is disposed between and coupled to both the prime mover and the air compressor, wherein the fluid coupling is a variable speed fluid coupling configured to have varying amounts of oil disposed therein to create variable speed control in the air compressor, wherein the prime mover is configured to operate at a constant speed regardless of the amount of oil in the fluid coupling, and wherein the control system is configured to increase and decrease the amount of oil in the fluid coupling throughout operation of the air compressor to drive the air compressor.

2. The drill rig of claim 1, wherein the fluid coupling includes an input pump and a separately spaced output turbine that both rotate about a shared axis and are separated by a gap inside the fluid coupling.

3. The drill rig of claim 2, wherein the fluid coupling is a hydrodynamic device that includes oil within the gap to transfer momentum from the input pump to the output turbine.

4. The drill rig of claim 3, wherein the prime mover is coupled to the input pump and is configured to cause the input pump to rotate, causing oil adjacent the input pump in the gap to rotate and to be pumped toward the output turbine, thereby causing the output turbine to rotate.

5. The drill rig of claim 2, wherein the air compressor includes a main rotor, and wherein the output turbine is coupled to the main rotor of the air compressor such that rotation of the output turbine causes rotation of the main rotor.

6. The drill rig of claim 2, further comprising an additional turbine disposed between the input pump and the output turbine.

7. The drill rig of claim 2, wherein the fluid coupling includes a lock-up structure that physically links and connects the input pump to the output turbine when the input pump is increasing in speed and reaches a predetermined speed threshold.

8. The drill rig of claim 7, wherein the predetermined speed threshold is 70% of a maximum operating speed of the input pump.

9. The drill rig of claim 7, wherein the lock-up structure includes a pad on at least one of the input pump and the output turbine that expands radially due to centrifugal force.

10. The drill rig of claim 7, wherein the lock-up structure eliminates slippage between the input pump and the output turbine at full operating speeds.

11. The drill rig of claim 1, wherein the air compressor is an oil flooded rotary screw air compressor having a main rotor that rotates about a first axis and a secondary rotor coupled to the main rotor that rotates about a second axis, and wherein both the main rotor and the secondary rotor are disposed within a stator housing.

12. The drill rig of claim 11, wherein the stator housing includes an air inlet port and an air outlet port, wherein the main rotor includes helical lobes and grooves along a length of the main rotor, and wherein the secondary rotor includes helical lobes and grooves along a length of the secondary rotor.

13. The drill rig of claim 1, further comprising a hydraulic pump coupled to and powered by the output turbine, wherein the hydraulic pump is separate from the fluid coupling.

14. The drill rig of claim 1, wherein the control system is configured to vary the amount of oil in the fluid coupling based on an amount of air needed for a given borehole.

15. The drill rig of claim 1, wherein the control system is configured to remove only a portion of the oil from the fluid coupling during a standby period of the air compressor, and to add oil back in to the fluid coupling after the standby period has passed, wherein the prime mover is configured to continue operating at its constant speed throughout the removal and addition of oil.

16. The drill rig of claim 1, wherein the control system is configured to increase and decrease the amount of oil in the fluid coupling throughout operation of the air compressor to drive the air compressor at varying speeds while the prime mover remains operating at its constant speed, wherein the control system is configured to increase and decrease the amount of oil in the fluid coupling to correspond to an amount of air needed for a given borehole, and wherein the control system is configured to remove at least substantially all of the oil from the fluid coupling during a standby operation of the drill pipe while the prime mover remains operating at its constant speed, and to add oil back into the fluid coupling after the standby period.

17. A method of operating an air compressor on a drill rig, the method comprising:

varying an amount of oil within a fluid coupling that is coupled to both the air compressor and to a prime mover, wherein the fluid coupling drives the air compressor and the amount of oil in the fluid coupling is controlled via a control system; and while varying the amount of oil, maintaining a constant speed of the prime mover to generate slippage between an input pump in the fluid coupling and an output turbine in the fluid coupling, thereby creating variable speed control in the air compressor throughout operation of the air compressor.

18. The method of claim 17, wherein the method includes removing some of the oil from the fluid coupling when the drill rig is not drilling, thereby causing the output turbine and a main rotor in the air compressor to slow down.

19. The method of claim 18, wherein the method includes adding oil into the fluid coupling when the drill rig begins to drill, thereby causing the output turbine and the main rotor in the air compressor to speed up.

20. The method of claim 17, wherein the method includes removing all or substantially all of the oil from the fluid coupling during an extended shutdown period of the drill rig, thereby creating a disconnect between the input pump and the output turbine, and wherein during the extended shutdown period the prime mover continues to operate at the constant speed.

21. The method of claim 17, wherein the fluid coupling includes a lock-up structure that physically links and connects the input pump to the output turbine when the input pump is increasing in speed and reaches a predetermined speed threshold.

22. The method of claim 21, wherein the predetermined speed threshold is 70% of a maximum operating speed of the input pump.

23. The method of claim 21, wherein the lock-up structure eliminates slippage between the input pump and the output turbine at full operating speeds.

24. The method of claim 17, further comprising varying the amount of oil in the fluid coupling based on an amount of air needed for a given borehole.

25. The method of claim 17, further comprising removing only a portion of the oil from the fluid coupling during a standby period of the air compressor, and adding oil back in to the fluid coupling after the standby period has passed and continuing to operate the prime mover at its constant speed throughout the removal and addition of the oil.

26. The method of claim 17, further comprising:

increasing and decreasing the amount of oil in the fluid coupling to correspond to an amount of air needed for a given borehole, and removing at least substantially all of the oil from the fluid coupling during a standby operation of the drill rig while the prime mover remains operating at its constant speed, and adding oil back into the fluid coupling after the standby period.

* * * * *